United States Patent [19]

Hayhoe

[11] 4,376,396

[45] Mar. 15, 1983

[54] RETAINING AND BRAKING APPARATUS FOR USE WITH POWERED ROTATIONAL FORCE APPLICATOR TOOL

[76] Inventor: Michael Hayhoe, 2918 Allenby Rd., R.R. 6, Duncan, British Columbia, V9L 4T8, Canada

[21] Appl. No.: 243,256

[22] Filed: Mar. 12, 1981

[51] Int. Cl.[3] ..... B25B 17/00

[52] U.S. Cl. ..... 81/57.14; 81/58.2

[58] Field of Search ..... 81/57.14, 57.3, 58.2

[56] References Cited

U.S. PATENT DOCUMENTS

| | | | |
|---|---|---|---|
| 1,890,213 | 12/1932 | Cameron et al. | 81/58.2 |
| 2,536,172 | 1/1951 | Halperin | 81/60 |
| 2,938,416 | 5/1960 | Maness | 81/57 |
| 3,535,960 | 10/1970 | Borries | 81/57.14 |
| 3,620,105 | 11/1971 | Batten | 81/57.14 |
| 3,979,977 | 9/1976 | Dorma | 81/57.13 |
| 3,979,977 | 9/1976 | Dorma | 81/58.2 |
| 4,064,772 | 12/1977 | Boyd et al. | 81/57.13 |

*Primary Examiner*—James L. Jones, Jr.

*Attorney, Agent, or Firm*—Christensen, O'Connor, Johnson & Kindness

[57] ABSTRACT

A powered tool for applying rotational force to a turnbuckle includes a power drive unit and a tool head mounted to the power drive unit. The tool head has a first slot formed therein adapted to permit passage of the turnbuckle therethrough. A force application disc is rotatably mounted in the tool head for applying rotational force to the turnbuckle. A second slot is formed in the disc and is adapted to receive the turnbuckle. A transmission unit is associated with the power drive unit and the force application disc to transmit power from the drive unit to the disc tending to rotate the disc. A retaining and braking mechanism is mounted on the tool head for selective movement between a first position adjacent the first slot and a second position spaced from the first slot. When the retaining and braking mechanism is in the first position, it cooperates with the tool head to prevent passage of the turnbuckle through the first slot. When the retaining and braking mechanism is in the second position, it cooperates with the transmission unit to oppose rotation of the disc.

11 Claims, 4 Drawing Figures

Fig. 2.
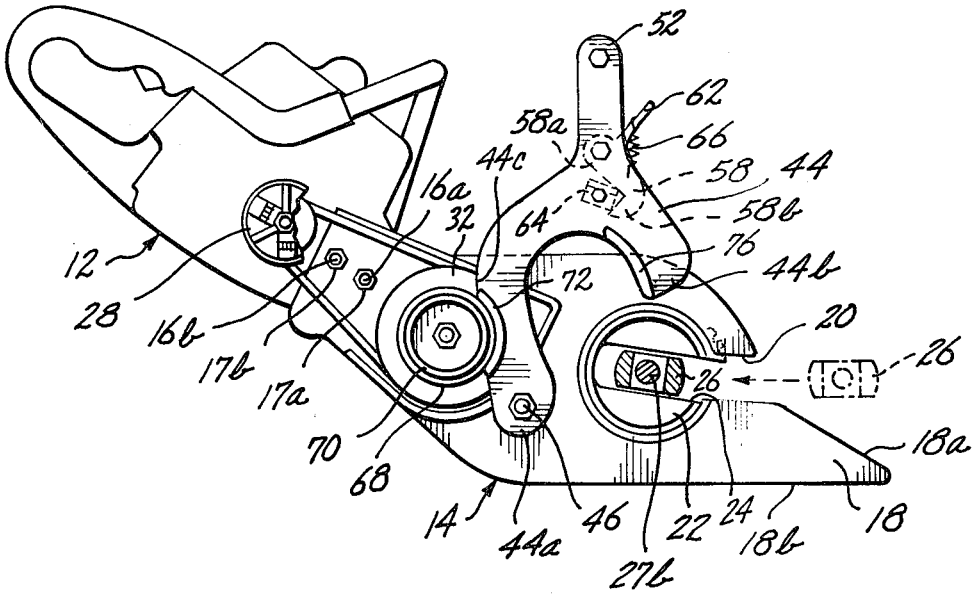
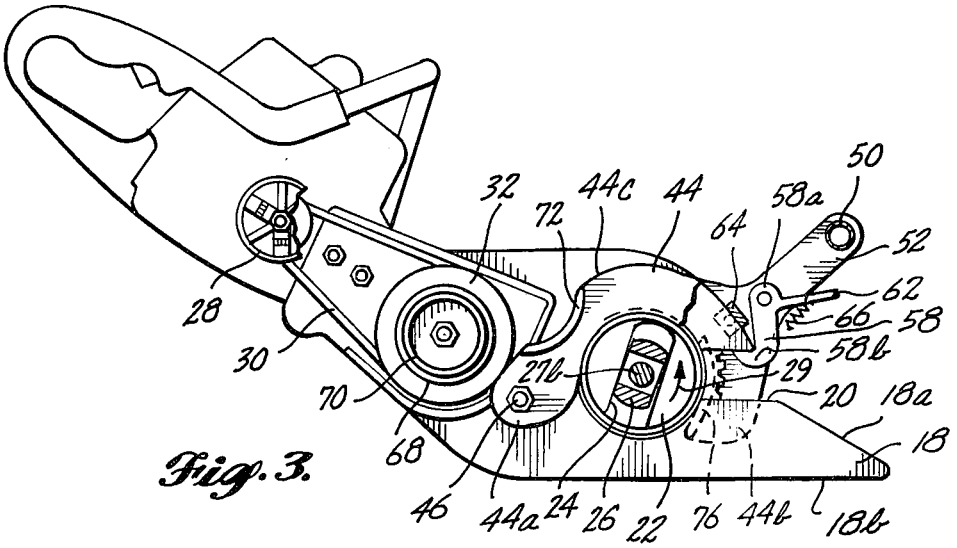
Fig. 3.

RETAINING AND BRAKING APPARATUS FOR USE WITH POWERED ROTATIONAL FORCE APPLICATOR TOOL

BACKGROUND OF THE INVENTION

This invention relates to powered devices for applying torsional force to fasteners e.g., turnbuckles and other objects and, more particularly, the invention relates to an improved retaining and braking apparatus for use in such a powered device.

It is well-known to use a turnbuckle affixed to a chain or cable as a means for increasing the tension on the chain or cable. Two common applications of such chain, cable and turnbuckle arrangements are in guy wires for providing stability to radio antennas or other towers and in lashing down cargo aboard ocean-going vessels. The conventional method for turning the turnbuckle in order to increase the tension on the chain or cable attached thereto is to insert a rod through the turnbuckle, then apply force on the rod to rotate the turnbuckle, thereby increasing the tension on the chain or cable. Such manual procedures for tightening turnbuckles make the task of tightening the turnbuckle tedious, time-consuming and physically tiring. The inefficiency of manual tightening is a special problem on ocean-going vessels since one of the important factors in determining whether such vessels are profitable is the amount of turnaround time in unloading and reloading a vessel once it reaches port. The time-consuming job of lashing down cargo by manually tightening the turnbuckles attached to the lashing chains and cables greatly increases the amount of in-port time for any cargo vessel.

Powered wrenches or other devices for applying a torsional or rotational force to a fastener or other object are known in the prior art. An example of such a device is in U.S. Pat. No. 3,535,960 to Borries, issued Oct. 27, 1970. The use of such devices for turning turnbuckles has been limited by several factors. One such factor is in the size of the powered devices presently manufactured. The other is in the relatively high torsional force required to satisfactorily tighten a chain or cable such as in holding down cargo on an ocean-going ship which will be subjected to severe movement due to the waves encountered in the ocean crossing. In order to properly utilize a powered device to tighten the turnbuckle it is necessary to have positive assurance that the device will not slip off the turnbuckle during the tightening procedure. Slippage of the tool can be particularly hazardous during the high torque application encountered in tightening the turnbuckles of cargo lashings.

A further requirement of the use of any high torque, powered, wrench-like device in tightening turnbuckles is the necessity of providing some means by which the powered device can be placed on the turnbuckle or other fastener and removed therefrom. In the case of a nut or bolt head, the wrench can be placed easily over the top of the nut or bolt head and removed in a reverse manner. When dealing with a turnbuckle, however, the problem is aggravated by the fact that the turnbuckle is usually attached at both ends either to a long length of continuous chain or cable or to some stationary structural member so that it is impossible to slide the wrench onto the turnbuckle from either end. The wrench therefore must be applied to the turnbuckle directly from the side of the turnbuckle at a 90° angle. Such an arrangement necessitates the placement of a slot in the head of the wrench or other device so that it can be slipped over the turnbuckle from the side. It is necessary that the slot in the head be properly aligned for placement of the device over the turnbuckle at the start of the operation and similarly aligned at the finish of the tightening operation so that the tool can be easily removed from the turnbuckle.

It is therefore an object of the present invention to provide a retainer mechanism for use with a powered tool for applying rotational force to a turnbuckle to prevent the turnbuckle from inadvertently becoming disengaged from the tool during tightening.

It is a further object of this invention to provide a retainer mechanism which is easily releasable by the operator of the powered tool while still maintaining a positive retaining capability and protection against accidental release.

It is another object of this invention to provide an apparatus for applying braking force to a turnbuckle tightening tool to permit the operator to stop the rotational motion of the apparatus at a point where the head of the tool is properly aligned for placement of the tool head on the turnbuckle or removal of the head from the turnbuckle.

It is an object of this invention to provide a retainer mechanism and brake apparatus which are integrated into a single operational unit.

It is a further object of this invention to provide a mechanism as described above that is simple to operate and maintain and relatively inexpensive to manufacture.

SUMMARY OF THE INVENTION

In accordance with the above-stated objects, a retaining and braking mechanism for use with a powered tool for applying rotational force to a turnbuckle or other fastener is provided. The powered tool includes a power drive source, e.g., a gasoline engine. A tool head is attached to the power drive source and includes a turnbuckle receiving jaw having a slot formed in a first end thereof for reception of the turnbuckle into the tool head. A slotted force application disc is mounted for rotational movement within the tool head. The turnbuckle to be tightened passes through the slot in the jaw and is received into the slot in the force application disc. The force application disc is drivingly coupled by means of a gear train to the power drive source so that the power drive source will cause the force application disc to rotate, thereby applying rotational force on the turnbuckle and turning the turnbuckle to tighten it with respect to the chain or cable to which it is attached.

The retaining means of the present invention includes a pair of retaining arms located on either side of the force application disc. The arms are pivotally mounted on the tool head and are movable by the power tool operator to place the retaining arms in blocking position adjacent the turnbuckle to prevent the turnbuckle's release from the slot in the force application disc.

Preferably, the retaining arms are integrally formed with a brake member which is operable to contact a brake pad associated with the gear train such that application of brake pressure from the braking member on the brake pad tends to resist movement of the gear train, thereby retarding rotation of the force application disc.

In a preferred embodiment the retainer mechanism includes a latch for releasably locking the retaining arms in their blocking position to prevent accidental movement of the retaining arms out of the blocking position during operation of the power tool.

BRIEF DESCRIPTION OF THE DRAWINGS

The objects and advantages of the present invention will be better understood by those of ordinary skill in the art and others upon reading the ensuing specification in conjunction with the accompanying drawings wherein:

FIG. 2 is a side elevational view of the powered turnbuckle tightening tool of FIG. 1 with the retaining and braking mechanism positioned to allow entry of a turnbuckle into the power tool.

FIG. 3 is a side elevational view of the retaining and braking mechanism of FIG. 1 with the retaining and braking mechanism in its retaining position.

DETAILED DESCRIPTION OF THE PREFERRED EMBODIMENT

Figure 1:
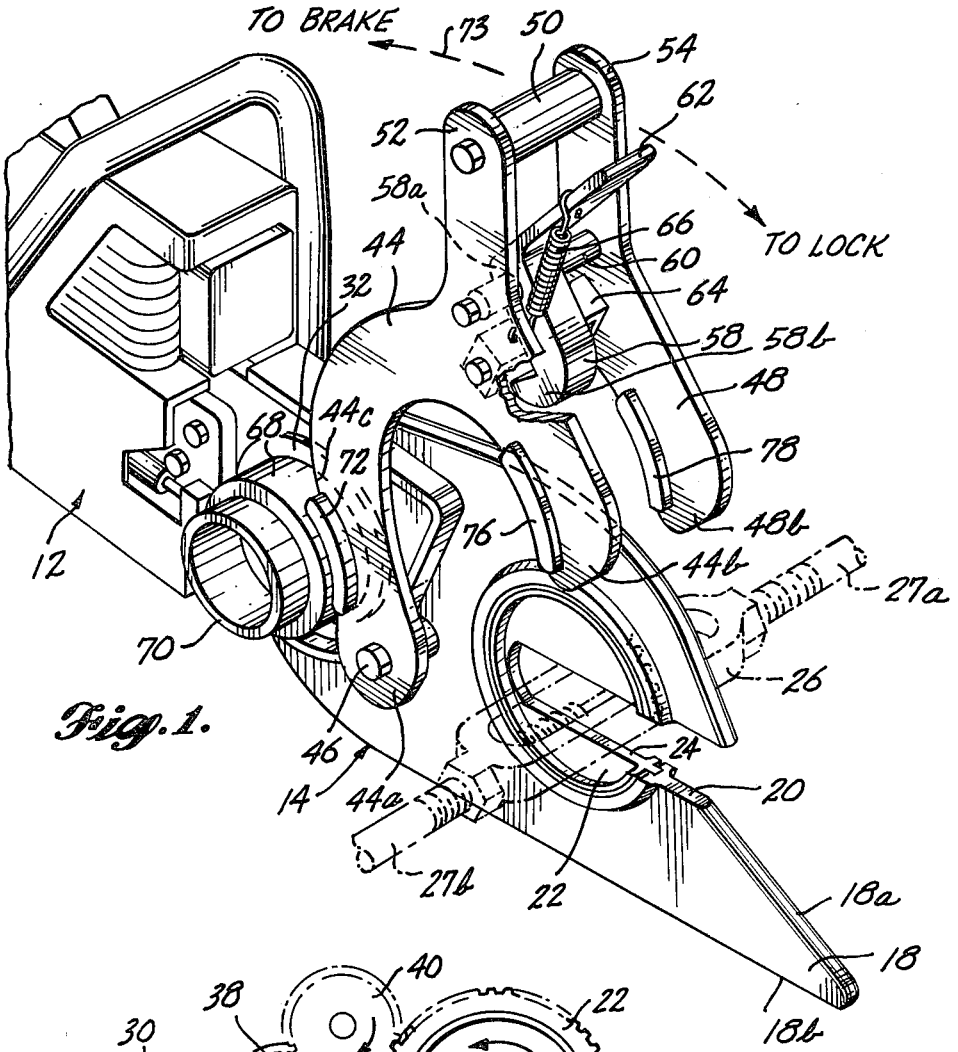
FIG. 1 is an isometric view of a powered turnbuckle tightening tool including a retaining and braking mechanism made in accordance with the principles of the present invention.

Referring now to FIGS. 1, 2 and 3, the retaining and braking mechanism of the present invention is shown mounted on a powered tool for applying rotational force to a turnbuckle. While the invention will be described in the context of its use in the environment of turnbuckle tensioning equipment, it will be recognized by those of ordinary skill in the art and others that the invention can be used on a variety of powered tools used for applying rotational force to various fasteners, capstans and other objects.

The powered turnbuckle tightening tool includes a power drive source. The power drive source can be any suitable power means, for example, an electric motor or gasoline engine. In the illustrated embodiment the power drive source comprises a gasoline engine 12 of the type used in chain saws. A suitable engine has been found to be the one utilized in the AB Partner "55" chain saw manufactured by and commercially available from the AB Partner Co. of Sweden.

A tool head 14 is affixed to the engine 12 in place of the normal chain saw bar by a pair of bolts 16*a*, 16*b* which pass through holes formed in a first end of the tool head and are threadably secured by associated nuts 17*a*, 17*b*. The tool head 14 includes a triangular nose portion 18 that extends from a second end of the tool head. The upper edge 18*a* of the nose portion slopes rearwardly and upwardly to a slot 20 formed in the second end of the tool head.

A circular opening is formed in the tool head adjacent the slot 20 and a force application disc 22 is rotatably mounted therein for rotation in the plane of the tool head. The portions of the tool head surrounding the perimeter of the circular opening provide a bearing surface against the perimeter of the force application disc 22. The force application disc 22 has a radial slot 24 formed therein which begins at the perimeter of the disc and extends past the center of the disc. The disc 22 is capable of rotation to a starting position such that the slot 24 in the disc 22 is aligned with the slot 20 in the tool head to permit entry of a turnbuckle 26 into the radial slot 24, as best seen in FIG. 2.

Figure 4:
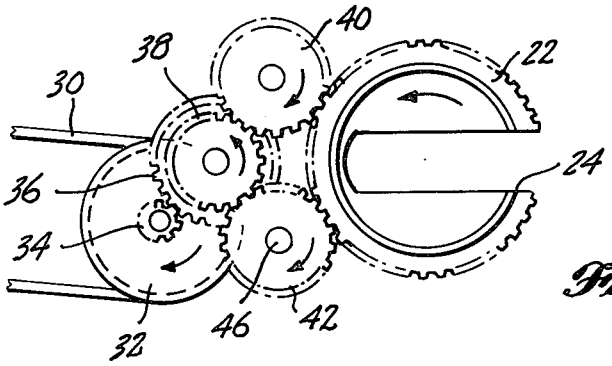
FIG. 4 is a schematic view of the drive train of the powered turnbuckle tightening tool pictured in FIG. 1.

The engine 12 and its casings, handles and controls are unchanged from their conventional configuration utilized in the AB Partner "55" chain saw. The engine 12 drives a first pulley 28 which in turn drives a V belt 30 which engages the first pulley 28 and also engages a somewhat larger second pulley 32 mounted for rotational movement on the tool head 14. The cooperative relationships of the elements of the drive train are shown somewhat schematically in FIG. 4. The second pulley 32 has a primary drive gear 34 coaxially affixed thereto such that rotation of the second pulley 32 causes rotation of the primary drive gear 34. The teeth of the primary drive gear 34 drivingly engages a first follower gear 36, also rotatably mounted on the tool head for rotation about an axis parallel to the axis of rotation of the second pulley 32 and primary drive gear 34. The first follower gear 36 has a secondary drive gear 38 affixed coaxially thereto such that rotation of the first follower gear 36 causes simultaneous rotation of the secondary drive gear 38. The secondary drive gear 38 drivingly engages a pair of idler gears 40 and 42 rotatably mounted on the housing. The first and second idler gears 40 and 42 are mounted for rotation in the same plane as the force application disc 22 in the tool head 14. The first and second idler gears 40 and 42 drivingly engage gear teeth extending radially from the perimeter of the force application disc 22; therefore, rotation of the first pulley 28 by the engine 12 will in turn drive the second pulley 32 which, transmit rotational motion to the force application disc 22 through the gears 34, 36, 38, 40 and 42. The presence of the radial slot 24 in the force application disc 22 causes a gap in the series of teeth formed around the perimeter of the disc. In order to maintain smooth rotation of the force application disc 22 and prevent the disc from being stopped by a lack of engagement between the idler gears and the disc teeth, the idler gears 40 and 42 are spaced from one another such that the respective points of engagement of the teeth of the idler gears with the teeth of the disc are spaced apart a distance greater than the width of the radial slot 24. Therefore, the teeth of at least one of the idler gears are always engaged with the teeth of the force application disc.

In operation the powered turnbuckle tightening tool is positioned such that the turnbuckle 26 is received by the radial slot 24 formed in the disc 22. The turnbuckle typically is threadably engaged with first and second threaded rods 27*a* and 27*b* such that rotation of the turnbuckle about its elongate axis in a first direction (shown by arrow 29 in FIG. 3) draws the ends of rods 27*a* and 27*b* toward one another to increase tension on a chain or cable (not shown) to which the rods are affixed. Once the turnbuckle 26 is positioned within the radial slot, the engine 12 is run to rotate the force application disc 22 by means of the drive train described above to turn the turnbuckle 26 and increase tension on the associated cables or chains. Preferably, a conventional clutch arrangement within the chain saw is adjusted so that when the turnbuckle is turned sufficiently to place the desired maximum tension on the chains or cables the clutch slips, thereby allowing the engine to run free without further rotation of the drive pulley 28 and in turn without rotation of the force application disc 22. A typical tension value in the cargo ship lashing environment is about 7,000 lbs.

During the procedure of tightening the turnbuckle 26 it is desirable that the turnbuckle be retained within the slot 24 in a positive manner so that the operator of the tool does not have a exert undue force to maintain the position of the tool on the turnbuckle and to prevent accidental slippage of the tool from the turnbuckle which could result in injury to personnel. A first retainer arm 44 is substantially C-shaped, as best seen in FIG. 2. The first retainer arm 44 is pivotally attached at a first end 44*a* to a shaft 46 extending from the tool head. The shaft 46 is colinear with the axis of rotation of the second idler gear 42 and the first retainer arm is free to pivot about the shaft 46. A second retainer arm 48, substantially identical to the first retainer arm 44, is pivotally mounted on the opposite side of the tool head 14 on the opposite end of the shaft 46. The first and second retainer arms 44 and 48 are connected to one another by means of a handle rod 50 affixed to elongate first and second extensions, 52 and 54 respectively, extending from the retainer arms 44 and 48 at a location between the first end and the second end of the respective retainer arms. The first and second extensions 52 and 54 are substantially perpendicular to lines tangent to the retainer arms. The handle rod 50 serves to provide a handhold by which the operator can maneuver the pair of retainer arms 44 and 48. In operation the retainer arms 44 and 48 can be pivoted about the shaft 46 into a retaining position such that the second ends 44*b* and 48*b* of the retainer arms are adjacent the turnbuckle 26. In the retaining position, the retainer arms flank the tool head adjacent slot 20 and the inner perimeter of the retainer arms acts as a retaining surface to maintain the turnbuckle 26 within the slot 24.

A latching mechanism is provided to maintain the retainer arms in their retaining position and includes a hook member 58 mounted for pivotal motion about an axis perpendicular to the plane of retainer arms 44 and 48. The hook member 58 is mounted on the retainer arms by means of a pivot pin 60. The pivot pin 60 passes through a first end 58*a* of the hook member and is affixed to the first and second retainer arms adjacent the first and second elongate extensions 52 and 54. A bias arm 62 extends orthogonally from the first end 58*a* of the hook member and the hooked end 58*b* of the hook member is biased against a stop member 64 mounted between the retainer arms adjacent the pivot pin 60. The biasing of hook member 58 is provided by a coil spring 66, a first end of which is attached to the bias arm and a second end of which is attached to the retainer arm 44, as best seen in FIG. 2.

Referring now to FIG. 3, the retaining mechanism is shown in its retaining position with the retainer arms 44 and 48 blocking the exit path of the turnbuckle 26 from the slot 24. The hooked end 58*b* of the hook member is releasably engaged below a portion of the tool head 14 which lies immediately above the slot 20 in the tool head to latch the retaining mechanism into its retaining position. When the turnbuckle is to be removed from the powered tool the hook member 58 is disengaged from the tool head by exerting force on the bias arm 62 counter to the compression force of the spring 66 releasing the hook member from engagement with the tool head. The retainer arms and associated assembly is then free to pivot away from the retaining position.

In order to remove the turnbuckle from the power tool it is necessary to stop the force application disc 22 in a position such that the radial slot 24 is in cooperable relation with the slot 20 in the tool head to provide a clear path for the turnbuckle to exit the tool head of the power tool. Also, since the disc 22 has been stopped by the above-described clutch mechanism reacting to resistance provided by the turnbuckle, at the time the tool is removed from the turnbuckle, there will no longer be a force from the turnbuckle causing the clutch to disengage. The disc will therefore begin to rotate and the engine would have to be stopped to stop the disc for placement of the tool on the next turnbuckle to be tightened. In order to allow the tool to be moved from turnbuckle to turnbuckle without repeated stopping and starting of the engine a braking mechanism is provided that retards motion of the force application disc 22 and allows the operator to stop the disc in any desired position. The braking action is provided by a rear surface 44*c* of the retainer arm 44 that is movable into a braking position to contact a brake pad 68 which extends about the outer perimeter of a cylindrical drum 70. The drum 70 is mounted externally of the tool head 14 on an extension of the shaft upon which the second pulley 32 rotates. The second pulley and the drum 70 are fixed to the shaft so that they must turn in unison. When it is desired to stop the rotation of the force application disc 22 the operator exerts force on the retainer mechanism, pulling it toward the engine 12 (in the direction of arrow 73 in FIG. 1) thereby applying pressure from the rear surface 44*c* of the first retainer arm 44 against the brake pad 68, thereby tending to retard rotation of the drum 70 and, in turn, the second pulley 32. A portion of the rear surface 44*c* of the first retainer arm is concave to closely fit against the curved surface of brake pad 68. The braking force can be maintained on the drum as long as it is desired to stop the rotation of the disc 22 so that the turnbuckle tightening tool can be removed from the turnbuckle and placed on another turnbuckle in preparation for tightening the cable or chain associated with the second turnbuckle.

In the preferred form of the invention the retainer arms 44 and 48 are made of a lightweight metal such as aluminum. While the use of aluminum keeps the weight of the tool to a minimum it also means that the wear on the arms 44 and 48 is great, particularly along surface 44*c* which contacts the brake pad 68 and along the inner edge of the second ends 44*b* and 48*b* of the retainer arms which contact the turnbuckle when the arms are in the retaining position. It is therefore preferable to attach protective shoes to the high wear portion of the retainer arms. The shoes are preferably made of steel or some other hard, long wearing substance. A brake shoe 72 is affixed to the surface 44*c* of the first retainer arm to contact the brake pad 68. Wear shoes 74 and 76 are affixed to the inner edges of second ends 44*b* and 48*b*, respectively, of the first and second retainer arms to bear the majority of contact with the turnbuckle 26.

The forward portion of the tool head is adapted for ease of use. The bottom edge 18*b* of the nose portion 18 is substantially straight edge and provides a suitable resting pedestal for the power tool. It is particularly useful in the cargo ship environment where a turnbuckle is used to tighten chains or cables holding cargo containers in position on the deck of the ship. The flat bottom edge 18*a* of the nose portion allows the operator to rest the power tool on the surface of the deck or a cargo container while tightening the turnbuckle associated with those containers. The upwardly and rearwardly slanting upper edge 18*a* of the nose portion provides a guide surface which guides the turnbuckle into the slot 20 and radial slot 24 with a minimum amount of guidance from the operator. The pointed nose also permits the tool to be easily slid out from under turnbuckle when the tensioning is complete, the slope permitting the turnbuckle to easily slide down the nose of the machine under tension of the cable or chain.

In summary therefore, a powered tool for tightening turnbuckles and other fasteners is disclosed which includes a tool head having a rotatable slotted force application disc mounted therein. The turnbuckle is received in the slot in the disc and rotational force is applied to the turnbuckle by rotation of the slotted disc. The forward nose portion of the tool head has a slot formed therein which cooperates with the radial slot in the rotatable disc to permit entry and exit of the turnbuckle. Preferably the nose of the power tool is substantially wedge-shaped forward of the slot in the tool head to provide a guide for the turnbuckle as it enters the slot in the force application disc and the lower edge of the nose is flat to provide a resting pedestal for the tool during operation.

A retaining and braking mechanism is provided operable to be moved between a retaining position and a braking position. In the retaining position the mechanism is located so as to cooperate with the tool head to substantially capture the turnbuckle within the slotted rotatable disc and prevent its inadvertent release during the tightening operation. When the tightening operation is completed the retaining and braking mechanism can be moved to its braking position, releasing the turnbuckle from the rotatable disc and simultaneously applying brake pressure to the power transmission means which drives the rotatable disc, thereby inhibiting movement of the disc to permit the radial slot in the disc to be aligned with the slot in the tool head to permit removal of the turnbuckle from the tool. By 180° reversal of the entire power tool assembly it is possible to utilize the power tool to loosen the turnbuckle in the same manner that the tightening operation is carried out as described above. The tool is placed on the turnbuckle from the opposite side and rotation of the disc will effectively be in a direction opposite the tightening direction.

While one embodiment of a powered tool for applying rotational force to a turnbuckle and a retaining and braking mechanism for use therewith has been illustrated and described it will be apparent to those of ordinary skill in the art and others that several modifications can be made to the power tool housing and braking and retaining mechanism as well as to the power drive source itself while remaining within the spirit and scope of the present invention. Therefore, the present invention should be defined solely by reference to the appended claims.

The embodiments of the invention in which an exclusive property or privilege is claimed are defined as follows:

1. A powered tool for applying rotational force to a turnbuckle comprising:

a power drive means;

a tool head mounted to said power drive means, said tool head having a first slot formed therein adapted to permit passage of said turnbuckle therethrough;

a force application disc mounted in said tool head for applying rotational force to said turnbuckle, said disc having a second slot formed therein adapted to receive said turnbuckle, said second slot being formed in the perimeter of said disc and extending radially past the center of said disc, said disc being mounted for rotational movement in said tool head;

power transmission means associated with said power drive means and said tool head for transmitting power from said power drive means to said disc so as to tend to rotate said disc;

retaining and braking means mounted on said tool head for selective movement between a first position adjacent said first slot and a second position spaced from said first slot, said retaining and braking means when in said first position cooperating with said tool head to prevent passage of said turnbuckle through said first slot and when in said second position cooperating with said power transmission means to oppose rotation of said disc.

2. The powered tool of claim 1 further including latching means associated with said retaining and braking means and cooperable with said tool head when said retaining and braking means is in said first position to releasably retain said retaining and braking means in said first position.

3. The powered tool of claim 1 wherein said retaining and braking means includes a first retainer arm and a second retainer arm, said first and second retainer arms constructed and arranged such that when said retaining and braking means is in said first position a portion of said tool head adjacent said first slot lies between said first and second retainer arms, said first and second retainer arms forming a barrier adjacent said turnbuckle when said turnbuckle is in said second slot such that said turnbuckle bears against at least a portion of said first and second retainer arms when said turnbuckle tends to move toward said first slot.

4. The powered tool of claim 3 wherein said first and second retainer arms are substantially C-shaped having an inner and outer perimeter, said turnbuckle bearing against said inner perimeter of said first and second retainer arms when said retaining and braking means is in said first position.

5. The powered tool of claim 3 wherein said power transmission means includes:

a first drive gear coupled in driven relationship to said power drive means, said first drive gear in turn being coupled in driving relationship to said disc;

a brake hub rigidly coupled to said first drive gear for simultaneous rotation therewith, said hub having an outer perimeter and constructed and arranged to cooperate with said retaining and braking means such that a portion of said first reatiner arm engages said outer perimeter when said retaining and braking means is in said second position to retard rotational motion of said brake hub.

6. The powered tool of claim 5 wherein said first retainer arm has an outer edge, said outer edge including a brake portion shaped to closely conform to said outer perimeter of said brake hub said brake portion contacting said brakes hub when said retaining and braking means is in said second portion.

7. The powered tool of claim 3 or 5 wherein said latching means includes:

a hooked member pivotally mounted between said first and second retainer arms, said hooked member releasably engaging a portion of said tool head adjacent said first slot when said retaining and braking means is in said first position; and, first biasing means associated with said first retainer arm and said hub member to bias said hooked member into engagement with said tool head portion.

8. The power tool of claim 6 further including:

a brake pad overlying at least a portion of the outer perimeter of said hub, said brake portion of said outer edge of said first retainer arm engaging said brake pad when said retaining and braking mechanism is in said second position.

9. The power tool of claim 8 wherein said brake portion of said outer edge includes a brake shoe of material relatively harder than said brake pad fixed to said brake portion at the location of contact with said brake pad to reduce wear on said brake portion.

10. The power tool of claim 3 further including wear shoes affixed to the portion of said first and second retainer arms that bear against said turnbuckles.

11. The power tool of claim 1 wherein said second slot is constructed and arranged such that when said turnbuckle is received into said second slot the center of rotation of said turnbuckle coincides with the center of rotation of said force application disc.

* * * * *